US005400842A

United States Patent [19]

Brisson

[11] Patent Number: 5,400,842

[45] Date of Patent: Mar. 28, 1995

[54] CURVED SAWING AND CUTTING OF TWO-FACED CANTS

[75] Inventor: Maurice Brisson, Laval, Canada

[73] Assignee: Les Ateliers Benoit Allard, Inc., Quebec, Canada

[21] Appl. No.: 144,872

[22] Filed: Oct. 29, 1993

[51] Int. Cl.[6] ..... B27B 1/00; B27B 31/00; B27L 11/00

[52] U.S. Cl. ..... 144/2 R; 144/39; 144/242 R; 144/242 C; 144/246 R; 144/246 G; 144/357; 144/378; 144/373

[58] Field of Search ..... 144/2 R, 3 R, 39, 41, 144/242 R, 242 C, 246 R, 246 G, 356, 357, 369, 377, 378

[56] References Cited

U.S. PATENT DOCUMENTS

| | | | |
|---|---|---|---|
| 4,239,072 | 12/1980 | Merilainen | 144/357 |
| 4,449,557 | 5/1984 | Makela et al. | 144/357 |
| 4,485,861 | 12/1984 | Nilsson | 144/357 |
| 4,548,247 | 10/1985 | Eklund | 144/357 |
| 4,572,256 | 2/1986 | Rautio | 144/378 |
| 4,599,929 | 7/1986 | Dutina | 144/357 |
| 4,881,584 | 11/1989 | Wislocker et al. | 144/378 |
| 5,148,847 | 9/1992 | Knerr | 144/378 |

*Primary Examiner*—W. Donald Bray
*Attorney, Agent, or Firm*—Omri M. Behr; Matthew J. McDonald

[57] ABSTRACT

A system used in combination with a cant sawing or cutting unit, the function of which is to guide two faced-cants through the cut along the line of their natural curvature. The system comprises, at the infeed end of the unit, rollers for clamping the opposite planar faces of the cant, thus providing it with a pivotal point, and also includes means for causing an angular displacement of the forwardly moving cant, from said pivotal point and relative to the sawing or cutting elements, thereby allowing the elements to cut along the natural curvature of the cant.

16 Claims, 4 Drawing Sheets

CURVED SAWING AND CUTTING OF TWO-FACED CANTS

FIELD OF THE INVENTION

The present invention relates to an apparatus for curved sawing and cutting of two-faced cants.

BACKGROUND OF THE INVENTION

It has long been recognized in the sawmill industry that the predominant cause of lumber loss in the conversion process results from natural defects of the sawlogs, the most important of which is curvature to some degree along the longitudinal axis. Since a large percentage of the logs obtained from the natural forests of North America, up to 40 % in some areas, falls in this particular category, sawmill technology has been striving for decades to cope with the problem of producing the maximum amount of merchantable lumber from crooked logs.

A first early technique consisted in hand guiding the piece through the cut by sidewise pressure, as visually determined by the operator, in order to conform with the observed form of the log or cant. As technical and mechanical advances took place from the early seventies onward, a rapid rise in feed capabilities occurred with the result that hand guiding became no longer practical, nor possible in most cases. Subsequently, there was brought forward a full array of complex mechanical arrangements which can cause the raw workpiece to go through a multiple cutting process along the line of its natural curvature.

While these developments have been most useful and productive, they also required large investments in specialized guiding equipment, either to be added to the infeeding system or to be incorporated into the production unit.

STATEMENT OF THE INVENTION

The present invention is concerned with a simple and reliable system to process two-faced cants along the line of their natural curvature, either in full resawing as in a "bull edger" or in four-sided squaring by a second double facing canter in the processing line.

A two-faced cant is normally produced by simultaneously removing from a log, either by sawing or chipping, an approximately equal volume from each side, after it has been rotated and maintained in such an angular position as to place its natural curvature in a plane parallel to that of the two faces being produced. It therefore follows in the succeeding four-sided squaring or perpendicular resawing operations that the maximum product volume will be obtained if the cuts, while being maintained at a constant spacing from one another, are caused to follow, even if only approximately, the curvature in the original form of the cant, rather than to proceed in a straight line as per normal sawing procedure.

With regard to cutting lumber along a curved line, it is a well known fact that, in a cant making or resawing operation, any accidental misalignment of certain elements of the feed system readily produces a detectable curvature in the sawn products, along a constant arc of a circle whose radius is relative to the amount of deviation imparted by the feeding means with regard to the orientation of the cutting elements. This phenomenon equally occurs in cant facing operation by means of cutterheads, such as in a vertically cutting chipper-canter, whenever lateral pressures exerted on the workpiece are unequal, due to improper setting of the outfeed guide rolls; the curvature thus produced, even while cutting an originally straight cant or log, is in relation to the net difference in the external forces laterally applied to the vertical faces. In this particular case, the pivotal point necessary in the angular change in direction of the work piece to produce curved cutting, is provided by the normal hold down elements in the infeed system which are located the closest possible distance in front of the canter.

The present invention pertains to the controlled utilization of the feeding elements of the machines concerned, i.e. the "bull edger" and the two-sided canter, so as to cause, whenever desirable, a calculated deviation of the cut from the straight line, according to the form scanning data of the original piece computer processed in order to determine a suitable angular setting of the feedworks elements with regard to the cutting planes.

It is a basic requirement in some existing examples of curved sawing or cutting technique that the amount of original curvature in the piece be first observed by some scanning device thus causing, through computer programming, the application of lateral pressures at various points along the length of the piece, in order to guide it through the cut according to the information gained by scanning.

Less evolved systems utilize a totally mechanical infeed guideworks which attempts to guide each segment of a curved cant or log within a short control area immediately preceding the cut. In this case, both the sensing and placing of the piece are accomplished by the same concave guide roll system while in contact with the rough sides of the piece.

The two presently used systems just described have the common drawback of not always maintaining the workpiece in the most favourable position, as the guidance achieved from mechanical contact with rough sides is dependent on whatever surface irregularities may be encountered along the length of the piece.

OBJECTS AND STATEMENT OF THE INVENTION

It is an object of the present invention to provide a control means for the perpendicular resawing or facing of two-faced cants while following the longitudinal axis of their natural curvature.

It is a further object to provide such control by means of guideworks contact solely with the plane faces of the workpiece previously produced by cutterheads or saws.

It is another object to provide a control system for the perpendicular resawing or facing of two-sided cants while following the longitudinal axis of their natural curvature, through a computer controlled guiding arrangement.

Yet, a further object is to provide a control system for the perpendicular resawing or facing of two-sided cants through a guiding procedure which is entirely carried out by contact of mechanical elements with the planar faces of the cant and unaffected by any natural surface irregularities encountered on its rough sides.

Another object consists in providing a control system for perpendicular resawing or facing of two-faced cants in order to ensure an optimum sawing entry prior to resawing or facing.

Another object of the invention is to provide such control system which accepts all classes of natural defects in the cants and limits stresses to the saws and other types of cutting elements to acceptable levels, because of its contact exclusively with planar faces of the cants, thus eliminating the need for previous inspection and rejection of raw pieces which could be found unsuitable to processes depending on cut guidance by contact with rough faces of the work piece.

The present invention therefore relates to a system mainly for directing a cant to follow its natural curvature, which comprises:

means for rollingly clamping a cant by its opposite planar faces to provide a pivotal point for the cant at the clamping; and means for causing longitudinally an angular displacement of the cant relative to the sawing or cutting elements whereby the cant is angularly moved while being clamped at the pivotal point to thereby allow the sawing or cutting process to follow the natural curvature of the cant.

Means are also provided to carry out a lateral displacement of the sawing elements or cutting heads in order to obtain the optimal sawing of facing entry of the cant.

The main difference in the approach taken by the present invention consists in effecting curved cutting guidance of the piece solely by contact of mechanical feeding elements with the planar faces produced either in a preceding operation or just previously in the processing machine concerned, thus avoiding the hazards of natural surface irregularities.

Three basic situations may be considered, in which this concept is applicable.

The first situation is a case of a two-faced cant bearing a curve in a plane parallel to its planar faces and being fed with said faces in the horizontal position, to a multiple resaw (bull edger) equipped with horizontal feed rolls and vertically mounted circular saws. The process begins with a full length scan of the cant while it is travelling along the infeed conveyor and maintained in contact with a fixed linebar guide by means of obliquely set crowding rolls.

As this scan is being completed, the resawing unit is positioned laterally by means of two linear positioners for the most favourable saw entry and skewing angle of the cutting lines, all in accordance with the computed scan information. If curvature of the cant has been detected, the rear train of outfeed press rolls assumes, by means of a third linear positioner, an angular position out of perpendicularity with the cutting planes established by the infeed press roll train and the saws, in the direction to suit either a right or left hand curve, such angular position corresponding to the cut deviation required by the original curve characteristics.

If one considers where to locate the pivotal point of any workpiece while it is being cut along a curved path by either circular saws or cutterheads, the ideal choice would be the intersecting point of the mean centerline of the piece with the axis of the cutting means. However, since mechanical difficulties prevent this optimal solution, the next best alternative consists in locating the pivotal point as closely as possible in front of said cutting means. This is provided in the present invention by a knurled or circumferentially grooved top press roll closely mounted in front of the saws, and a similarly-surfaced carrying roll located vertically under the cutting area.

The net result of the described arrangement is optimization in its most complete form, including both best saw entry positioning, best angular positioning (skewing) of the sawing lines, and smooth saw friendly guidance through curved cutting along any cant curvature detected by scanning.

Alternatively, and in accordance with the general principles already described, it would be possible, in a second situation, to effect the same complete form of optimization, by displacing the entire resawing unit angularly rather than merely causing a pivoting of its outfeed train, while also moving the unit laterally as previously explained. In this alternative the infeed works of the unit would be kept to a minimum length and the pivotal area of the workpiece would be established by external restraining means located closely to the front of the unit. This is to illustrate that the basic elements of the invention are compatible with a number of variations in the overall mechanical arrangement.

A third situation is the case of a two-faced cant bearing a curve in a plane parallel to its cut faces and being fed to a two-sided chipper-canter to produce a four-faced cant. The use of such canters has a long history in which one of the operational concerns is cant straightness after the cut. This quality of the cant is provided first by a pair of guide plates following the cutterheads and, in some machines, by vertical outfeed rolls beyond the guide plates.

It is known from decades of production time from this type of machines that the adjustment of the guide plate clearance and, whenever it applied, that of the outfeed guide roll positioning, are basic factors in straight cutting of cants. It can then be deduced that the programmed application of increased guide plate and roll pressure to one side of the cant as it feeds out of the cutterheads, will cause it to deviate in the opposite direction from the excess pressure and therefore produce, when desired, a cant with a curvature in relation to the amount of such differential.

The positioning for optimal saw entry is ensured by the displacement, either symmetrical or nonsymmetrical, of the cutter heads by means of linear positioners controlled by computer.

The pivotal point of the cant needed for curve cutting is provided, as already mentioned, by a pair of clamping rollers located at the infeed of the canter.

Therefore, it is required to determine by sectional form scanning the initial amount of deviation of the mean center line of the cant from the straight line and then to provide, through computer programming, the positioning of the cutter heads and the corresponding lateral offset of said guide plates and rolls which will cause cutting vertical faces in the piece along a longitudinal curve approximating the original one detected in the cant by the scanning means.

It will become evident in the more detailed description of the apparatus for each of the above described situations that a curved cut of appropriate radius can be executed in either resawing or face cutting, whether in the right or left handed direction, as well as straight line processing of the cant, as its condition requires.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

The following is a description of the curved or straight cut control system of the present invention, which system consists basically of mechanical components having contact solely with the planar faces of the workpiece in order to guide it through either full resawing or squaring off processes, whether in a straight line of optional orientation or along the natural curve of such piece as determined by scanning; this is achieved after an optimal positioning of saw entry in order to secure maximum yield in merchantable lumber. Such scanning, however, is well known in the art and the various steps involved electronically as a result of such scanning will not be described in detail.

For each of the following three embodiments described, an infeed conveyor moves a two-faced cant longitudinally, with planar faces in the horizontal position, through a scanner by means of obliquely set powered rollers which also serve to place and maintain the cant against a lateral linebar guide during its full length passage through the scanner, and while entering the processing unit.

Figure 1:
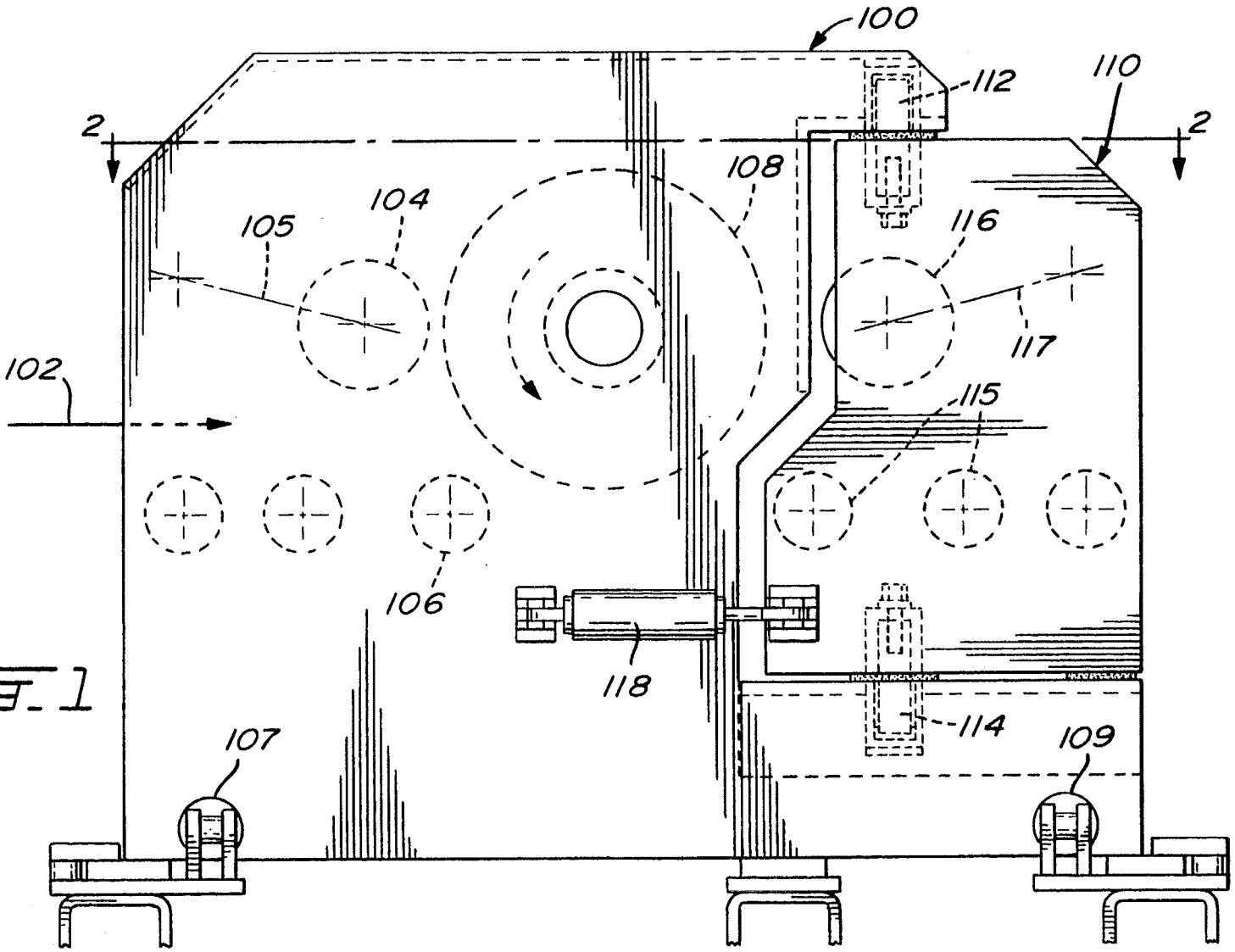
FIG. 1 is a side elevation of a sawing unit including a first embodiment of the invention.
Figure 2:
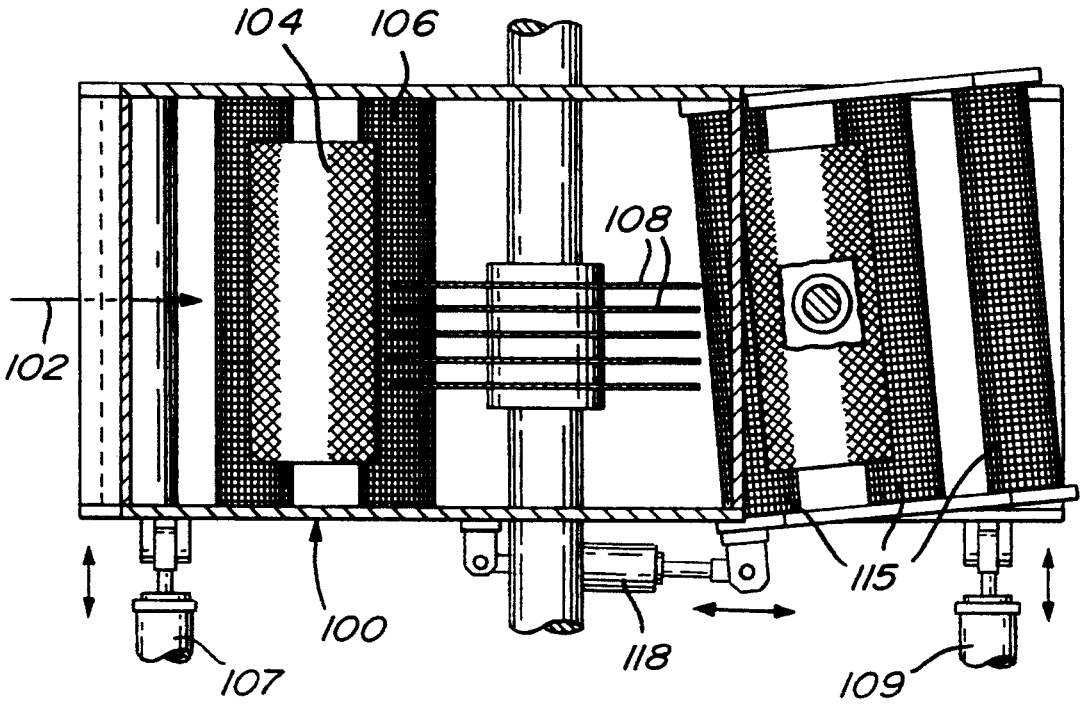
FIG. 2 is a top plan view thereof showing the unit in a position for a left-hand curve.
Figure 3:
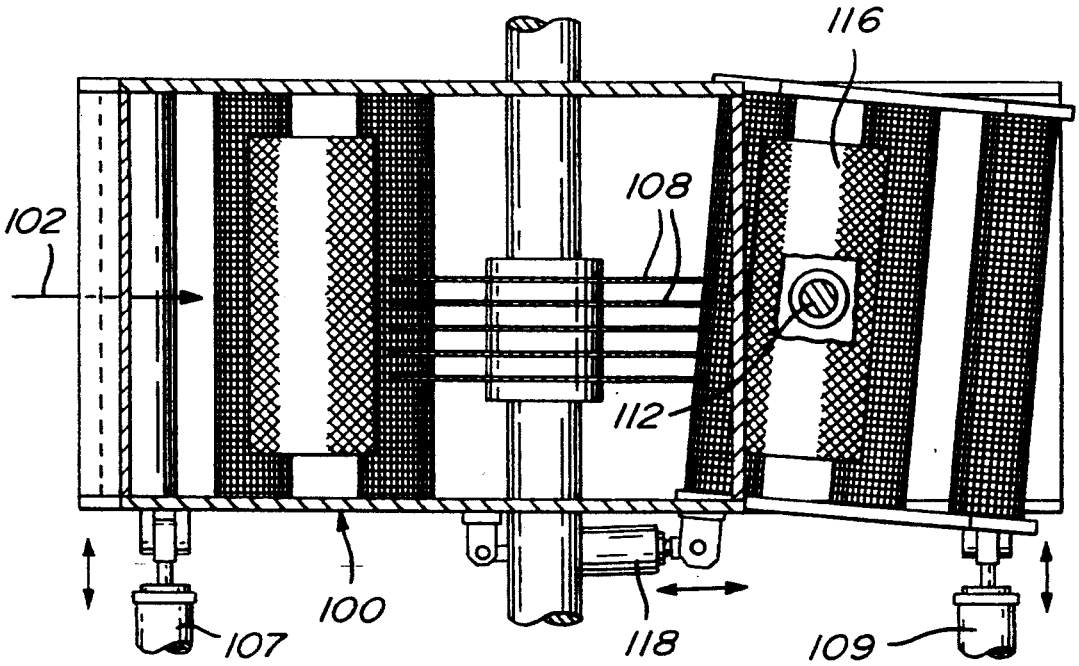
FIG. 3 is a top plan view thereof showing the unit in a position for a right-hand curve.

Referring to FIGS. 1, 2 and 3, illustrating the first embodiment as the piece enters the infeed side of the processing unit 100, as indicated by arrow 102, a knurled or circumferentially grooved top press roll 104 comes into contact with the upper face of the cant, while the latter advances to a similarly surfaced carrying roll 106 located just under the cutting area of the saws 108. The combination of these upper and lower rollers at close proximity to one another, creates a pivotal point area for the workpiece while its forward part is being pulled ahead and in a sidewise direction by the angularly displaced rear outfeed train, generally denoted 110, of the processing unit 100 which is displaced angularly by means of linear positioners 107 and 109 thus causing the saw cuts to curve by some amount corresponding to said angular positioning. This outfeed train 110 is pivotally mounted at 112 and 114 to the processing unit 100 and includes a series of horizontal rolls 115 cooperating with a press roll 116 to move the cant in the desired outfeed direction. Previous to this procedure, the unit 110 has been moved laterally by linear positioners 118 responding to a computerized decision as to the most favourable saw entry location and angular orientation of cut for optimum lumber output. Both press rolls 104 and 116 are pivotally mounted to a radial arm 105 and 117, respectively.

Figure 4:
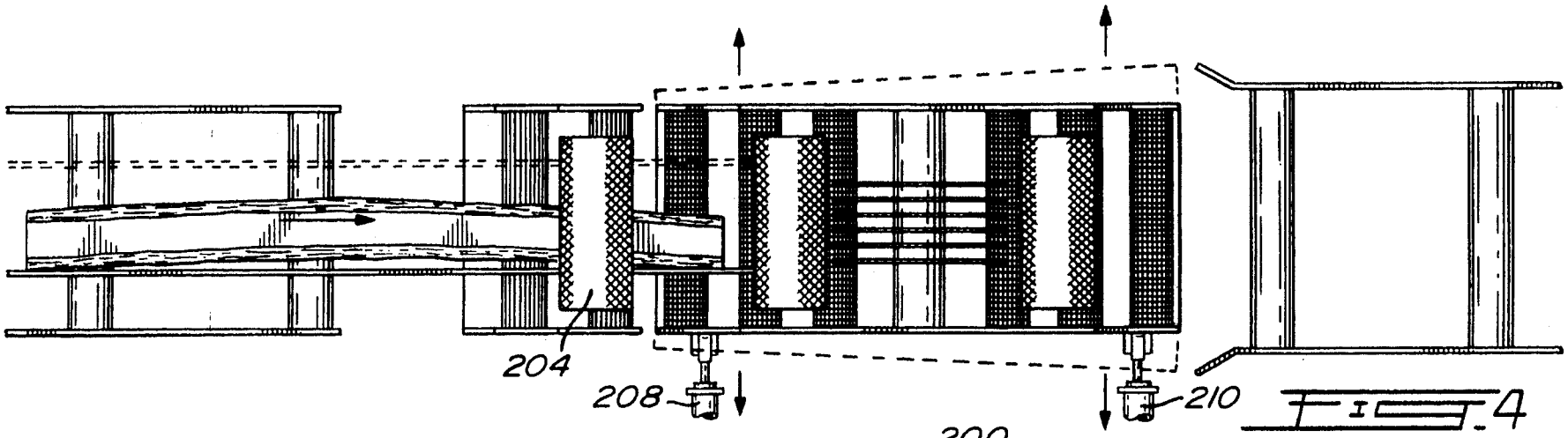
FIG. 4 is a top plan view of a sawing unit including a second embodiment of the invention showing the unit in three positions alternatively for right or left hand and straight cutting.
Figure 5:
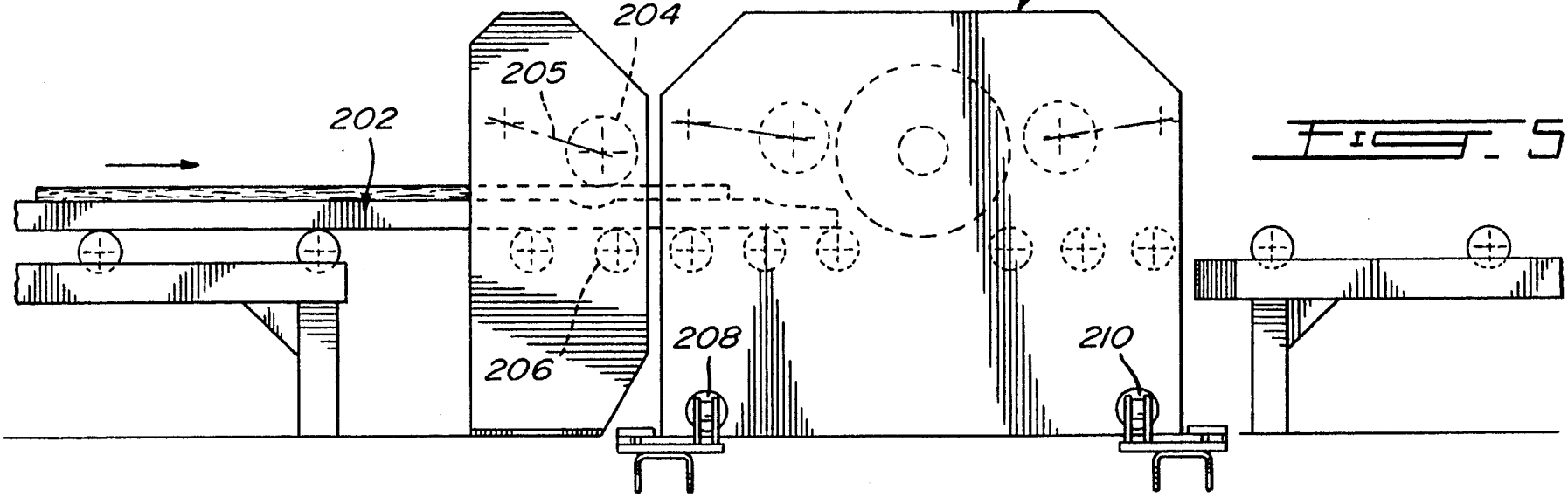
FIG. 5 is a side elevational view thereof.

Referring to FIGS. 4 and 5, a second embodiment of the present invention consists in a system where the main resawing unit 200 pivots integrally, while moving laterally at any programmed angle to attain best saw cut entry and cutting line orientation, following scanning of a straight or curved piece 202.

The infeeding system in this embodiment remains basically as already described and illustrated in FIGS. 1, 2 and 3, the only difference in the feed line consisting of relocating, frontwardly of the resawing unit 200, the arrangement of the knurled top roll 204 (pivotally mounted on radial arm 205) and bottom roll 206 thus providing a pivotal point for the workpiece in either direction imparted by the lateral positioners 208 and 210 of said unit 200.

Whatever mechanical simplification afforded in this embodiment must be weighed against the effect of a longer span of the initial cut not being under curved sawing guidance, and is mainly justified when processing longer lengths of incoming timber.

Figure 7:
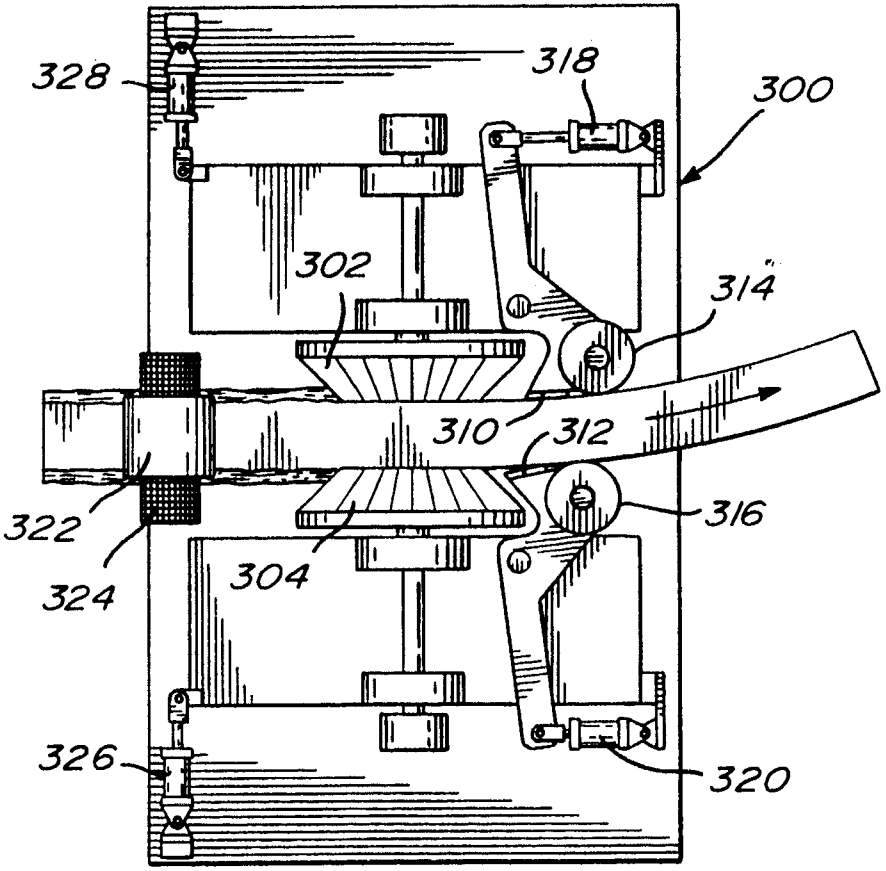
FIGS. 6 and 7 are two top plan views of a unit illustrating a third embodiment of the invention.
Figure 6:
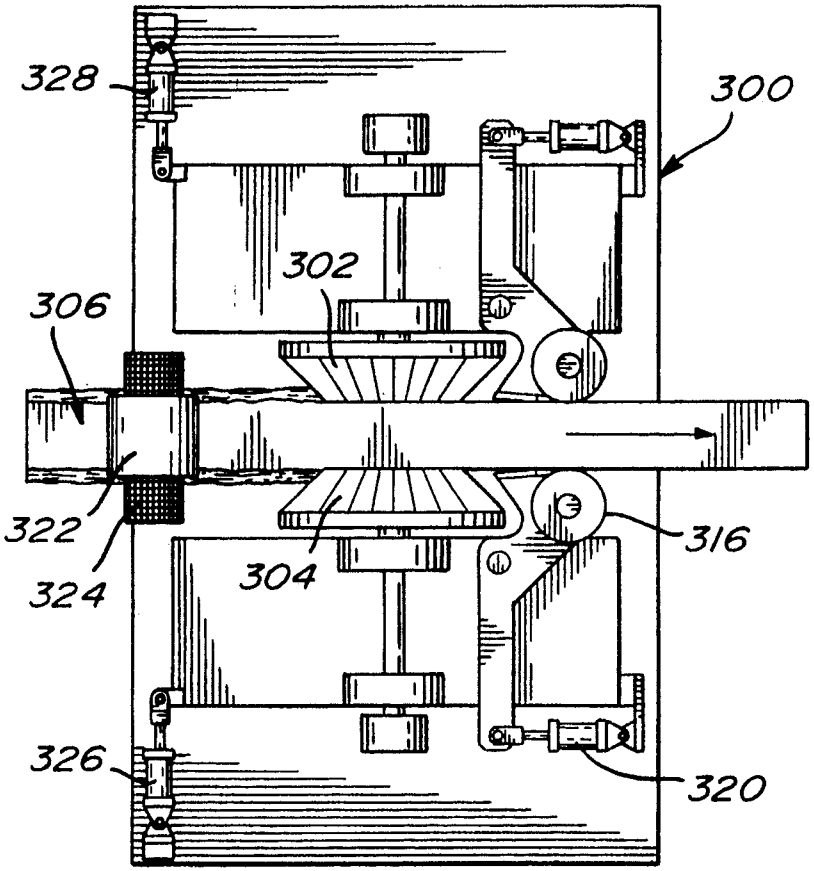

A third embodiment of the curved cutting process considered in this invention is shown in FIGS. 6 and 7; it concerns the squaring off with cutterheads 302 and 304 such as found in a chipper-canter unit 300, of a two-sided cant 306 which has already been faced parallely to its plane of curvature by a first canter or twin saws.

FIGS. 6 and 7 show the two-faced cant 306 being faced vertically and along the natural curve of its longitudinal axis, while being fed through the canter unit 300 in a horizontal attitude of its initially produced faces and axis of curvature. The initial curvature of the cant observed by scanning, is reproduced by computer control in the vertical longitudinal cuts, as a result of the unequal pressures applied on the newly cut faces by the outfeed guideworks of the canter consisting of guide plates 310 and 312 and outfeed rollers 314 and 316. Both guidework elements are positioned through computerized curve scanning data resolution transmitted to linear actuators 318 and 320 which are mechanically connected to the guideworks. The required pivotal point of the cant for curved cutting is provided by a pair of clamping rollers 322 and 324 located at the infeed of the canter 300.

The positioning for optimal saw entry is achieved by the displacement, either symmetrical or nonsymmetrical, of the cutterheads by means of individual linear positioners 326 and 328 which are computer controlled.

Although the invention has hen described above with respect with one specific form, it will be evident to a person skilled in the art that it may be modified and refined in various ways, It is therefore wished to have it understood that the present invention should not be limited in scope, except by the terms of the following claims.

I claim:

1. In combination with a fixed sawing unit equipped with elements for sawing two-faced cants having opposite planar faces, a system for directing a cant to follow, throughout the sawing process, its natural curvature comprising:

means upstream of said fixed sawing unit for, rollingly clamping at the infeed end of the unit the opposite planar faces of said cant to provide a pivotal point for said cant at the point of clamping; and means downstream of said fixed sawing unit for causing longitudinally an angular displacement of the cant while said cant is guided at said pivotal point to thereby allow the sawing process to follow the natural curvature of said cant.

2. A system as defined in claim 1, wherein said cant angular displacement causing means include a pivotally mounted outfeed train.

3. A system as defined in claim 2, wherein said cant angular displacement causing means include means for positioning said outfeed train at an angle corresponding to the natural curvature of said cant.

4. A system as defined in claim 3, wherein said positioning means extend between said pivotal point and said outfeed train.

5. A system as defined in claim 2, wherein, concurrently with the angular displacement of said outfeed train, said elements are laterally displaceable relatively to cant entry in order to obtain an optimal positioning of saw entry.

6. A system as defined in claim 1, wherein said elements consist of a series of vertically extending circular saws.

7. In combination with a unit equipped with elements for cutting two-faced cants having opposite planar faces, a system for directing a cant between fixed cutter heads in order to follow, throughout the cutting process, its natural curvature parallel to said planar faces, comprising:

means upstream of said fixed cutter heads for rollingly clamping at the infeed end of the unit the opposite planar faces of said cant to provide a pivotal point for said cant at the point of clamping; and means downstream of said fixed cutter heads for causing longitudinally an angular displacement of a curved cant relative to the cutting unit whereby said cant is cut along a curve while being guided at said pivotal point to thereby allow the cutting process to follow the natural curvature of said cant.

8. A system as defined in claim 7, wherein said causing means include guide means and roller means contacting said cant on the cut faces thereof.

9. A system as defined in claim 8, wherein said causing means further include positioning means of said guide and roller means to move said cant along its natural curvature.

10. A system as defined in claim 7, further comprising symmetrical or non-symmetrical displacement means for said cutter heads in order to obtain an optimal entry in accordance with the sectional profile of said two-sided cant.

11. A system as defined in claim 8, wherein said elements consist of a pair of opposite cutter heads.

12. A system as defined in claim 1, wherein said means upstream of the fixed sawing unit consist of a pair of rollers in contact with said planar faces of said cant, causing frictional restraint to sideways motion of the cant in the area of said contact and thereby providing said pivotal point for the cant.

13. A system as defined in claim 1, wherein said means downstream of the fixed sawing unit consist of one or more pairs of driven rollers in contact with said planar faces of the cant; said driven rollers being mounted in a frame provided with a pivotal axis and angular positioning means.

14. A system as defined in claim 12, wherein said rollers have a face pattern which enhances sideways control on the planar surfaces of the cant as it passes between said rollers.

15. A system as defined in claim 13, wherein said rollers have a face pattern which enhances sideways control on the planar surfaces of the cant as it passes between said rollers.

16. A system as defined in claim 14, wherein said face pattern consists of circumferential groovings.

* * * * *

UNITED STATES PATENT AND TRADEMARK OFFICE

CERTIFICATE OF CORRECTION

PATENT NO. : 5,400,842

DATED : March 28, 1995

INVENTOR(S) : Maurice Brisson

It is certified that error appears in the above-identified patent and that said Letters Patent is hereby corrected as shown below:

Column 4, line 40, delete "saw"

Column 5, line 59, insert after "mounted", -- through the assistance of positioner 118 --.

Column 5, line 63, delete "110", insert -- 100 --.

Column 5, line 64, delete "positioners 118", insert -- positioners 107 and 109 --.

Column 6, line 4, after "laterally" insert -- , --.

Signed and Sealed this

Twentieth Day of May, 1997

*Attest:*

Bruce Lehman

BRUCE LEHMAN

*Attesting Officer*

*Commissioner of Patents and Trademarks*